US005211246A

United States Patent [19]

Miller et al.

[11] Patent Number: 5,211,246

[45] Date of Patent: May 18, 1993

[54] SCOURING METHOD AND SYSTEM FOR SUPPRESSING FIRE IN AN ENCLOSED AREA

[75] Inventors: Ralph G. Miller; Jerry W. Lee, both of Seattle, Wash.

[73] Assignee: The Boeing Company, Seattle, Wash.

[21] Appl. No.: 358,838

[22] Filed: May 30, 1989

[51] Int. Cl.[5] ..... A62C 35/12

[52] U.S. Cl. ..... 169/62; 244/129.2; 169/46; 169/11; 169/10; 169/49

[58] Field of Search ..... 169/62, 46, 49, 11, 169/53, 47, 70, 5, 10; 244/129.2

[56] References Cited

U.S. PATENT DOCUMENTS

| | | | |
|---|---|---|---|
| 1,926,396 | 9/1933 | Midgley, Jr. et al. | 169/46 |
| 2,292,794 | 8/1942 | Paradise | 169/46 |
| 2,452,348 | 10/1948 | Beach | 169/46 |
| 3,303,886 | 2/1967 | Tattersall et al. | 169/5 |
| 3,313,353 | 4/1967 | Williamson et al. | 169/49 |
| 3,481,405 | 12/1969 | Ward | 169/53 |
| 3,524,506 | 8/1970 | Weise | 169/61 |
| 3,783,946 | 1/1974 | Petrinec et al. | 169/11 |
| 3,844,354 | 10/1974 | Larsen | 169/11 |
| 4,643,260 | 3/1987 | Miller | 169/46 |
| 4,646,848 | 3/1987 | Bruensicke | 169/62 |
| 4,646,993 | 3/1987 | Baetke | 244/129.2 |
| 4,726,426 | 2/1988 | Miller | 169/62 |

FOREIGN PATENT DOCUMENTS 631164 11/1978 U.S.S.R. .

*Primary Examiner*—Joseph F. Peters, Jr.
*Assistant Examiner*—Anne E. Bidwell
*Attorney, Agent, or Firm*—Hughes & Multer

[57] ABSTRACT

A fire suppression method and system for use in an enclosed area employs the denser-than-air characteristic of certain fire retardant materials. An enclosed area has an upper region, a middle region, and a lower region. The method and system disperses a fire retardant material in a layer across the top of the upper region while maintaining concentration of the material in the layer which is sufficient to suppress any fire with which the layer comes into contact The method permits the layer to descend from the upper region, through the middle and lower regions, until it settles near the floor of the area. The descent of the layer scours the entire area to locate and suppress fire. Dispersal means includes a conduit extending horizontally in the upper region having a horizontally extending opening for dispersing the fire retardant material into the layer. Dispersal means also includes a conduit with a plurality of downwardly directed nozzles, each nozzle having a baffle means. Velocities of dispersion of the fire retardant material are low enough to prevent the formation of air currents that would impede the descent of the layer, and high enough to permit adequate spreading of the fire retardant material in order to form the layer.

20 Claims, 4 Drawing Sheets

SCOURING METHOD AND SYSTEM FOR SUPPRESSING FIRE IN AN ENCLOSED AREA

BACKGROUND OF THE INVENTION

1. Field of the Invention

The present invention relates to enclosed area fire suppression methods and systems, and more particularly to enclosed area fire suppression methods adapted for use in settings which require high reliability yet minimal bulk, such as in aircraft.

2. Background Art

Enclosed area fire fighting methods are commonly used in aircraft and they may be used elsewhere as well. Critical features of these fire suppression methods are reliability and self-sufficiency. However, in aircraft and similar settings, efforts to minimize any on-board bulk, are also essential. This leads to long term efficiencies, including fuel savings Sometimes the bulkiest component in a fire fighting method is the extinguishant used to put out fire. As an example, this may be 300–400 pounds of Halon extinguishant in an aircraft system. Hence a difficult trade off sometimes arises between having an adequate system and one that saves bulk.

Minimum concentration of extinguishant within an enclosed area is necessary to suppress fire. A problem arises because the particular location of fire within a compartment is unpredictable. Thus, enclosed methods conventionally have filled a large sector entirely with a concentrated mixture of extinguishant. These methods do this essentially by thoroughly mixing extinguishant and air in the compartment.

Instead of selecting water as the extinguishant, aircraft fire suppression methods typically employ bromotrifluoromethane ("$CBrF_3$"), or a related compound bromochlorodifluoromethane, sold commercially as "Halon" compounds. Maintaining minimum concentration $CBrF_3$ in a compartment for prolonged periods presents a special problem. $CBrF_3$ is most practically stored onboard a vehicle or aircraft in liquid phase, under pressure. As pressure decreases during piping into the compartment, the $CBrF_3$ vaporizes. Within a system having conduits, this phase change is transient, and therefore it is difficult to achieve a steady state flow. Consequently, during a lengthy dispersion there is substantial waste of $CBrF_3$. U.S. Pat. No. 4,643,260—Miller addresses this problem. A pressure regulated conduit, formed by conduit sections 48, 52, and 56, which the patent shows, maintains the $CBrF_3$ in the liquid phase to the point of discharge.

While the flow problem of $CBrF_3$ has been addressed, the state of the art of enclosed area methods is still to try mixing extinguishants and air in the compartment. Because of the focus on mixing extinguishants with air, in many instances the thought of using the heavier-than-air characteristic of extinguishants is forgotten. $CBrF_3$ in the gas phase is about five times denser than air; bromochlorodifluromethane is also substantially denser than air. Thus, $CBrF_3$ descends through air, much as sand falls through water. The quantities of extinguishant which conventional methods use are unsatisfactorily large.

Another pertinent development has been improved techniques to detect fire quickly. For instance, fire detection methods in commercial aircraft detect fire in less than one minute. The implications of this capability include the fact that fire fighting methods which combat smaller, incipient fires have become more practical.

A search of the U.S. patent literature discloses the following:

U.S. Pat. No. 4,646,848 (Bruensicke) shows a fire suppression system for an aircraft having a main cabin, a plurality of subcompartments, and ducts 57 which connect the main cabin to the subcompartments. Once it is determined which subcompartment contains fire, a crew member with a hand held extinguisher directs an extinguishant through the appropriate duct to the fire.

U.S. Pat. No. 4,643,260 (Miller), the pressure controlled system for dispersing CBrF already discussed, discloses thorough mixing of extinguishant and air.

U.S. Pat. No. 3,524,506 (Weise) shows an apparatus which totally floods an aircraft compartment with an extinguishing agent.

U.S. Pat. No. 3,481,408 (Ward) shows a fire fighting aircraft which disperses a jet of extinguishant to put out a fire.

U.S. Pat. No. 2,452,348 (Beach) shows a discharge of extinguishing medium into an enclosure in such a way that the medium will sweep across the floor of the enclosure.

U.S. Pat. No. 2,292,794 (Paradise) shows a method where atomized moisture is dispersed above a fire and then allowed to descend on the fire. The moisture, which is sprayed from the ground to a location immediately above the fire, forms a bank or cloud over the fire. Then, heat from the fire vaporizes the moisture, expanding the cloud and extinguishing the fire.

U.S. Pat. No. 3,783,946 (Petrinec et al) shows a sequential extinguishant dispersion system, which maintains a concentration of extinguishant in an enclosed area for a prolonged period of time.

SUMMARY OF THE INVENTION

Accordingly, it is an object of the present invention to provide in an enclosed area a method and a system for suppressing fire which are compatible with the heavier-than-air characteristic of certain extinguishants.

Another object of the invention is to provide such a method and system which will operate reliably while saving extinguishant, so as to reduce the bulk of the extinguishant when it is stored.

Another object of the invention is to provide a simpler method and system for dispersing extinguishant, thereby reducing the number of components and cost.

The present invention accomplishes in the following manner these and other objects, which will be apparent from consideration of the detailed description and accompanying claims. The enclosed area of the present invention can be considered as having an upper region, a middle region, and a lower region. The method and system disperse fire retardant material in a manner such the material spreads across the top of the upper region to form a layer. The concentration of fire retardant material in the layer is sufficient to suppress any flame with which the layer may come into contact. The material is denser than air. Thus, the layer descends by gravity from the upper region through the intermediate and lower regions, finally settling near the floor of the compartment. The descent of the layer scours the entire sector through which the layer passes, thus locating and suppressing any fire in the sector. In accomplishing this task, the layer uses a relatively small quantity of the material. In a first embodiment of the invention, the velocities at which fire retardant material is introduced in the upper region are controlled within the following range: the velocities are sufficiently low to prevent such introduction from setting up air currents which would impede the ability of the descending layer to thoroughly scour the area; they are sufficiently high so that adequate spreading of material into the layer results. In the first embodiment, there are means for supplying material to a location at the top of the upper region of the enclosed area, conduit means at such location, and dispersal means connected to the conduit means for dispersing material. The conduit means extends horizontally across the top of the upper region. The conduit means has a casing connected thereto containing first and second passageway discharge means to discharge the material horizontally in opposite directions. As material flows through the first passageway discharge means, upper and lower first plates that form the first passageway discharge means deflect the path of travel of material, this deflection slowing the velocities of dispersal to within the desired range. The second passageway discharge means is similarly formed. The first passageway discharge means communicates with the conduit means to receive material; it has an extended opening substantially parallel with the conduit means for dispersing material in the upper region in a first horizontal direction in a manner arranged to spread the material in the upper region to form the desired layer. Similarly, the second passageway discharge means communicates with the conduit means and has an extended opening generally parallel with the conduit means for dispersing material in a second horizontal direction opposed to the described first direction, also in a manner arranged to spread the material in the upper region to form the desired layer. Thus, the first and second passageway discharge means serve as baffles to keep the velocities of dispersal within the range described before and they coact to disperse the fire retardant material forming the desired layer. The conduit functions essentially as a plenum.

A second embodiment of the material dispersal means of the invention also serves to regulate the velocities of dispersal of material. This includes the elements of the previously described embodiment with the following modifications. Connected to the described material supplying means is a conduit means having a nozzle means positioned at the top of the upper region of the enclosed area. The nozzle means has downwardly directed aperture means for releasing material in the upper region, downwardly extending link means connected to the conduit means, and horizontally arranged baffle or louver means fixed to the link means. During dispersal of material, the material flows from the conduit means, out of the aperture means and then strikes the baffle means to be directed laterally to form the layer of fire extinguishing material. The size of the aperture means and arrangement of the link means and baffle means, are arranged to slow the velocities of dispersal to within the desired range.

Other features of the present invention will become apparent from the following detailed description. Use of directions herein, such as "downward" and the like refer to the direction of gravity.

DESCRIPTION OF THE ILLUSTRATED EMBODIMENT

Figure 1:
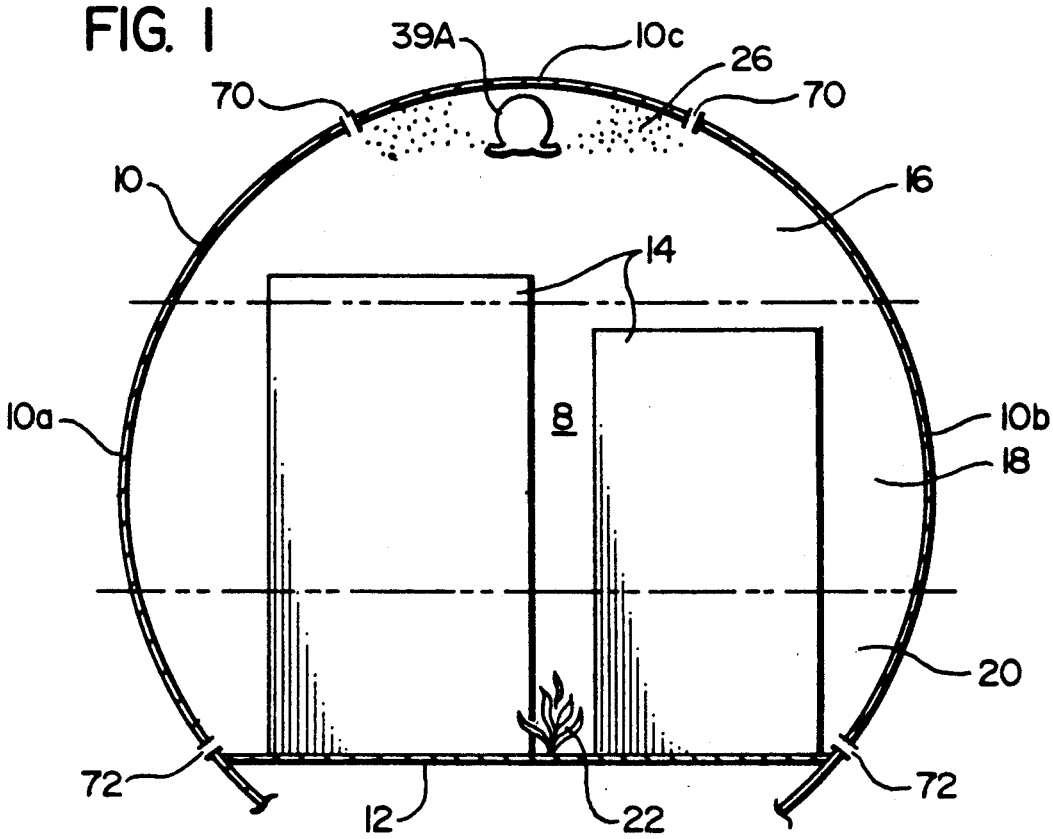
FIGS. 1–4 are sectional views representing an enclosed area wherein a method is practiced embodying the teachings of the present invention, and illustrating the method of the present invention in sequential stages.

An embodiment of the method of the present invention is illustrated in FIGS. 1–4. These figures show an area 8 defined by walls 10 and 12. The wall 12 is illustrated as forming a floor 12 for the area 8, and the wall 10 comprises side wall portions **10*a* and 10*b*, and a ceiling portion 10*c*, these wall portions 10*a*, 10*b* and 10*c* having a circularly curved cross sectional configuration. The area 8 is represented containing goods 14 resting on the floor 12. The area 8 for purposes of description may be considered as having an upper region 16, an intermediate region 18, and a lower region 20. Positioned at the top of upper region 16 is a discharge means 39A, for dispersing a fire retardant material 26. The discharge means is connected to a system for supplying material 26 (shown in FIG. 5**).

Figure 2:
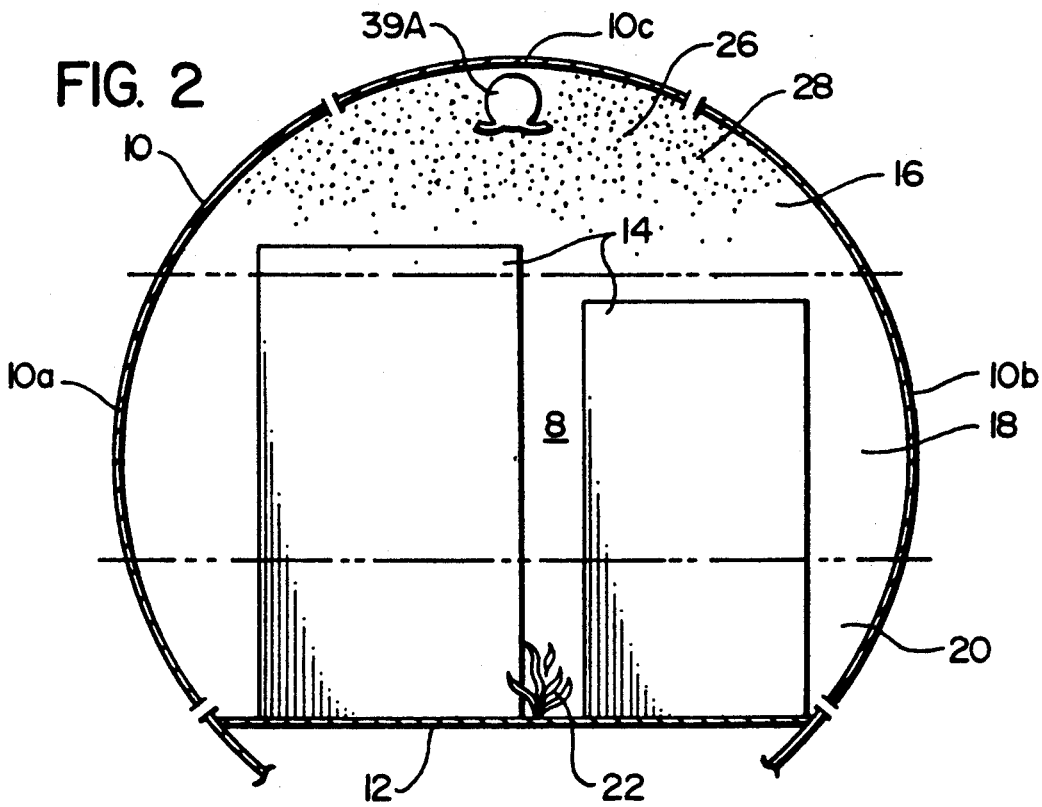
Figure 3:
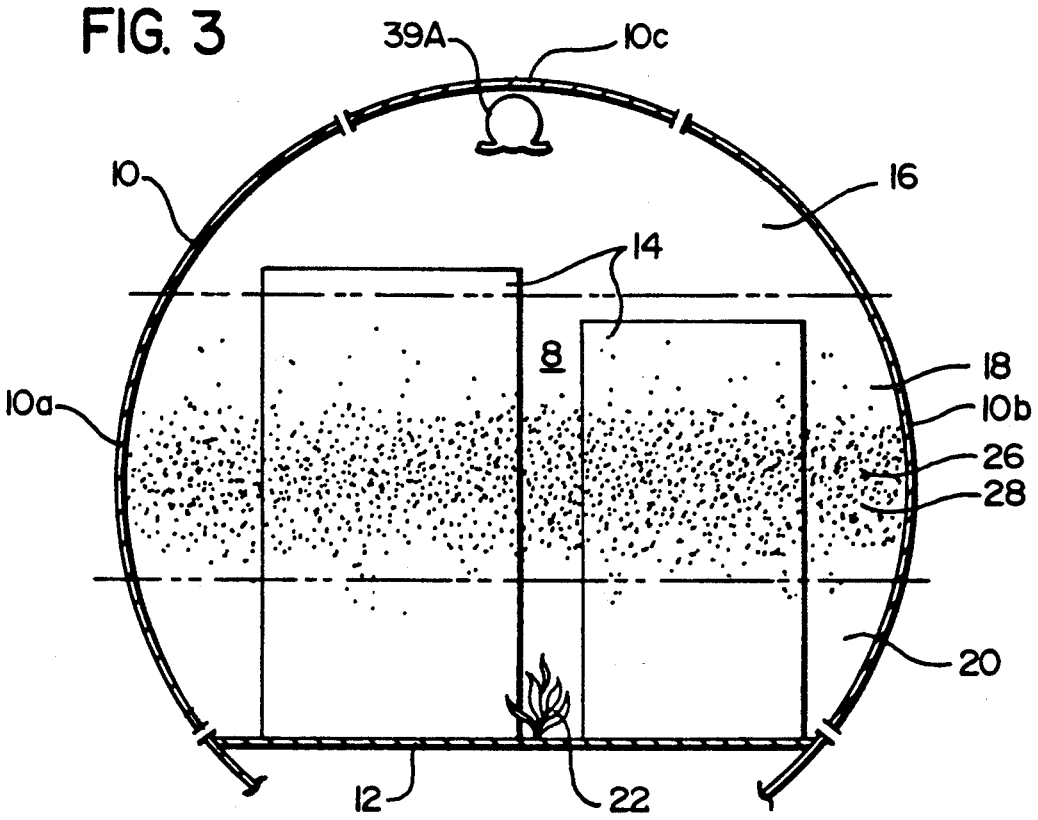
Figure 4:
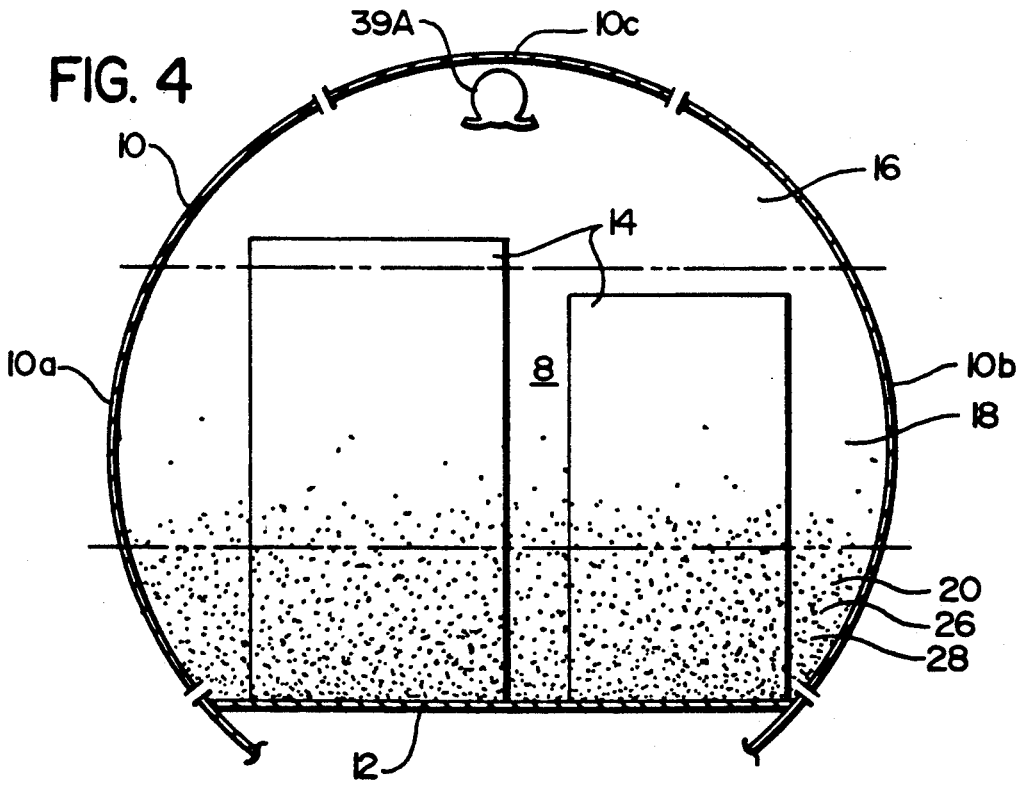

The figures illustrate the pattern of dispersion of the material 26. As FIG. 1 shows, once a fire 22 in the area 8 has been detected, the discharge means 39A begins to disperse the material 26 in two opposite, moderately upward, horizontal paths across the top of the upper region 16. Some of the material 26, which has lower velocities, descends immediately from the upper region 16. Some of the material 26 having greater velocities spreads across the top of the upper region 16. As FIG. 2 shows, when the discharge means 39A disperses sufficient material 26, the material 26 forms a layer 28 which completely covers a sector which is to be scoured. As FIGS. 2–4 show, the layer 28 descends from the upper region 16 through the intermediate and lower regions 18 and 20. Eventually, the layer 28 settles at the bottom of the area 8, thus reaching a steady state shown in FIG. 4. The effect of the described activity is to scour the area 8 with the fire retardant material 26. Persons using the method need not determine the precise location of the fire 22 in the area 8, such determination often being difficult to make in a smoke filled compartment.

To suppress fire, a minimum concentration of the material 26 in the layer 28 is rather critical. It is known that five percent by volume concentration is sufficient to achieve initial flame extinguishment where the material 26 is $CBrF_3$. (Three percent concentration $CBrF_3$ is sufficient if it is supplied for a longer time period.) Such minimum concentration is maintained throughout layer 28. It is also important that the material 26 in the layer 28 be denser than air. The material 26 being denser than air, the layer 28 maintains an appropriate concentration of the material 26 as the layer 28 descends through the area 8. Also, the material 26 should not diffuse easily into the air, the material 26 having a coefficient of diffusion like that of $CBrF_3$ 0.08 $cm^2$/sec.)

The layer 28 is illustrated as covering the entire area 8 during its descent; alternatively, the layer 28 may cover only a part or sector of the area 8 (not illustrated), the fire 22 being known to be within the covered sector.

Preferably, the velocities at which the material 26 discharges from the discharge means 39A into the layer 28 should fall within the following described range. Such velocities should be sufficiently low to prevent the dispersion of the material 26 from setting up air currents in the area 8 which would impede the ability of the layer 28 to scour thoroughly the area 8. Additionally, such velocities should be sufficiently high so that adequate spreading of the material 26 into the layer 28 can occur, so as to form the layer 28 in a manner to cover adequately the desired sector of the area 8. To achieve this range, it is contemplated that the means of discharging fire retardant material described below will dispense such material at velocities which are substantially lower than those of methods conventionally used for Halon compounds in fire suppression systems, for example U.S. Pat. No. 4,643,260 (Miller). Such velocities are readily ascertainable by those skilled in the art, so these will not be discussed in detail herein.

Figure 5:
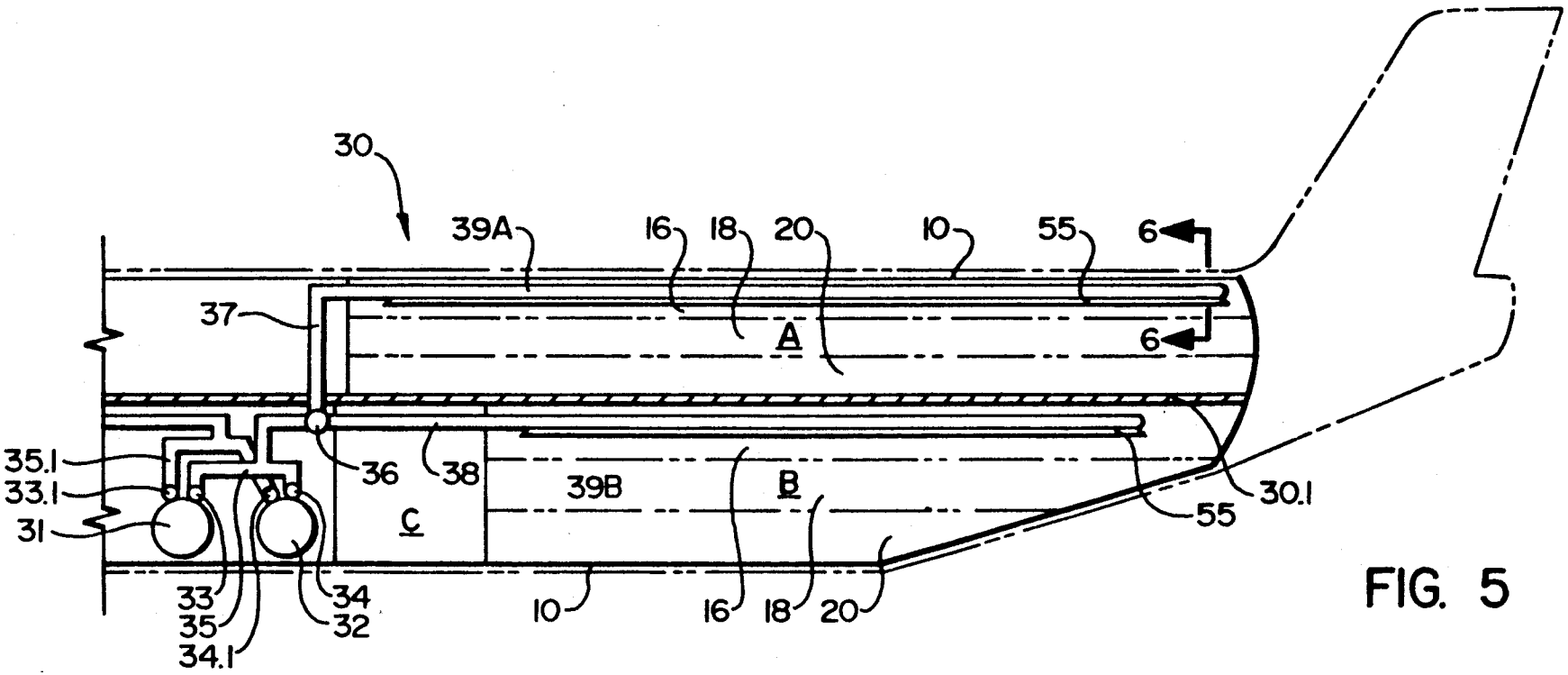
FIG. 5 is a side view of the interior of an aircraft in which the present invention is used, with part of the airplance fuselage removed for purpose of illustration.
Figure 6:
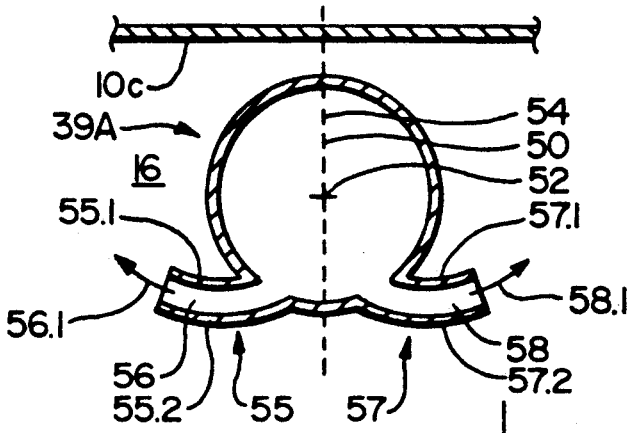
FIG. 6 is a transverse sectional view taken along plane 6 of FIG. 5, which shows an embodiment of a dispersal assembly.
Figure 7:
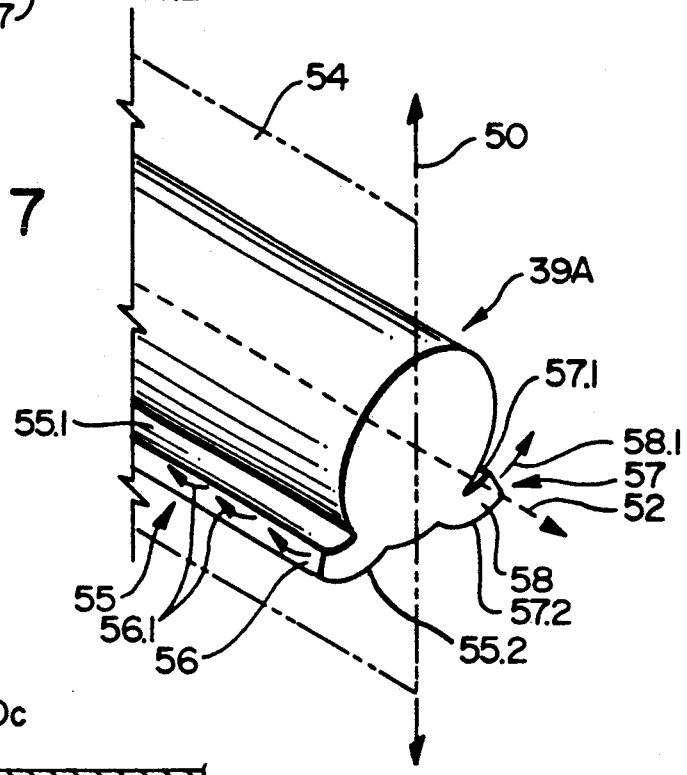
FIG. 7 is a perspective view of the dispersal assembly of FIG. 6.

FIGS. 5–7 illustrate an embodiment of a system for supplying and dispensing the fire retardant material 26 in accordance with the teachings of the present invention. FIG. 5 presents an aircraft 30, in which are illustrated a main deck compartment A, a lower cargo compartment B which is adjacent to compartment A, and a wing box C. The compartments A and B have walls 10 and are divided by a deck 30.1. Additionally, the compartments A and B may be considered as having upper regions 16, intermediate regions 18, and lower regions 20. In the body of the aircraft 30, there is means for dispensing fire retardant material which comprises the following items: Storage bottles 31 and 32, valves 33 and 33.1 connected to the bottle 31 and valves 34 and 34.1 connected to the bottle 32; a conduit section 35 connected to the valves 33 and 34 and a conduit section 35.1 connected to the valves 33.1 and 34.1; a valve 36 connected to the conduit section 35; a vertical conduit section 37 and a horizontal section 38 both connected to the valve 36; a conduit 39A, which is connected to the vertical conduit section 37, extending horizontally across the upper region 16 of the compartment A; and a conduit 39B, connected to the horizontal conduit section 38, extending horizontally across the upper region 16 of the compartment B. The conduits 39A and 39B are each exposed in the upper regions 16.

In operation, the bottles 31 and 32 store extinguishant $CBrF_3$ under pressure. The valves 33, 34, and 36 direct the $CBrF_3$ to either or both the conduit 39A or the conduit 39B. The $CBrF_3$ is vaporized by the time it reaches the conduits 39A and 39B. FIGS. 6 and 7 illustrate the conduit 39A. The conduit 39A for purposes of description may be considered as having vertical and longitudinal axes 50 and 52 and a longitudinally disposed locating plane 54 containing the axes 50 and 52 shown in FIGS. 6 and 7. Additionally, the conduit 39A has attached thereto a casing 55 having a top wall 55.1 and a lower wall 55.2 defining a first discharge passageway or nozzle 56 which is shown as sloping away from the conduit 39A and also away from the plane 54. The passageway 56 describes an arc of about 60°. Accordingly, it receives $CBrF_3$ from the conduit 39A and deflects the path of travel of the material as such material is being dispersed into the upper region 16 of the compartment A. Passageway 56 has a horizontal opening extending its entire length. Passageway 56 directs fire retardant material in a first direction 56.1 across the upper region 16. It is important that passageway 56 not direct the material downward, but rather horizontally in order that the material will travel along a horizontal exit plane to form the layer of fire suppressing material in the upper region 16. Due to the intensity of the material 26, the nozzle 56 can direct the material upwardly, so as to give it a trajectory across the top of upper region 16. Similarly, on the side of the conduit 39A which is opposite from the passageway 56 there is a casing 57 attached to the conduit 39A having a top wall 57.1 and a bottom wall 57.2 defining a second discharge passageway or nozzle 58. Passageway 58 slopes away from the conduit 39A and also away from the plane 54. Passageway 58 also describes an arc of about 60°. It receives $CBrF_3$ from the conduit 39A and deflects the path of travel of fire retardant material. Passageway 58 also has a horizontal opening through which the material is dispersed into upper region 16 in a second direction 58.1, opposed to the first direction 56.1. Again, it is important that the passageway 58 not direct the fire retardant material downward, but rather horizontally so that the fire retardant material travels along a horizontal exit plane; it can direct the material upwardly. The conduit 39A is identical to the conduit 39B, therefore further detailed description of conduit 39B is deemed unnecessary. It can be appreciated that two design factors which help to control the velocities of discharge are (i) reduction of line pressure of the fire retardant material, by use of a plenum or other means, and (ii) deflection of the path of travel of the material being discharged. The conduits 39A and 39B receive gaseous $CBrF_3$ and served as plenums holding the gas. Also, the discharge passageways or nozzles 56 and 58 function essentially as baffles, further controlling the velocities of dispersal of fire retardant material into the compartments. It is speculated that an inside diameter of two inches more or less in the conduits 39A and 39B is appropriate, depending upon the size of the compartment in which the conduits 39A and 39B are positioned. Note that conduits 39A and 39B do not need to extend the entire length of their respective compartments A and B. Also, the valves 33.1 and 34.1 and the conduit 35.1 are connected operably to similar valves, conduits, and dispersal components in other compartments, which are not shown.

Figure 8:
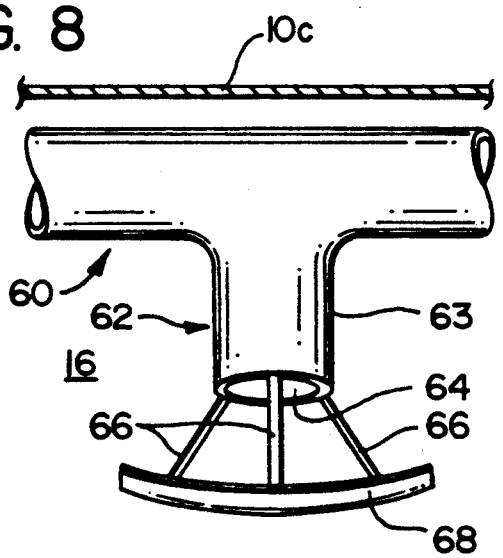
FIG. 8 is a perspective view of another embodiment of dispersal assembly.

FIG. 8 shows a second embodiment of dispersal means for regulating the velocities of dispersal. A conduit or plenum 60 is connected to means for supplying fire retardant material which is not shown. A plurality of evenly spaced dispersal assemblies 62 (FIG. 8 shows only one of these) is operably connected to a conduit 60. The assemblies 62 are positioned at the top of upper region 16 near a ceiling 10c. An assembly 62 is illustrated as comprising a nozzle 63, having an aperture 64 which is directed downward; a plurality of downwardly extending links 66 connected to the nozzle 63, and a horizontally arranged louver or baffle member 68 which is fixed to links 66. In operation, fire retardant material is dispensed downwardly from the nozzle 63 through aperture 64. The aperture 64. The stream of material strikes the member 8 which slows the velocity of dispersion of the material. The material forms a cloud around the assembly 62 which grows, spreading across the top of upper region 16 to form the layer 28.

In suppressing fire, the described method requires only a fraction of fire retardant material that is conventionally needed. It is estimated that in $CBrF_3$ methods, this savings is about twenty five to perhaps fifty percent of the bulk of $CBrF_3$ previously required.

It is to be noted that the described method is still effective when the area 8 is not airtight. FIG. 1 shows two intake vents 70 and two exhaust vents 72. Air may be introduced from outside the area 8 through the vents 70, and air and the material 26 may exit the area 8 to the outside through the exhaust vents 72. Correspondingly increased amounts of the material 26 may be needed in these circumstances in order to maintain an appropriate concentration of the material 26 in the layer 28.

In any of the above embodiments of the present invention, added safety can be obtained in the following manner. After the layer 28 has scoured the desired sector thoroughly and suppressed fire therein, a person with a hand held extinguisher can administer further fire retardant material to prevent any smoldering from rekindling.

It is to be understood that various modifications could be made to the present invention without departing from the basic teachings thereof.

What is claimed:

1. A method of combatting a fire that is known to be with a fire suppression sector within a enclosed area, said area containing air and having an upper region, and intermediate region, and a lower region, said method comprising:

a. dispensing a fire retardant material to form in said upper region a layer of at least a minimum concentration of said material that is sufficient to suppress flame, said layer extending substantially continuously across said sector, said material having a density and a particle size such that said layer is to descend through said air by gravity;

b. permitting said layer to descend from said upper region through said intermediate and lower regions;

c. maintaining said air in said sector sufficiently still so as to permit said layer of at least said minimum concentration, while descending from upper region through said intermediate and lower regions, to extend substantially continuously across said sector, whereby said sector is traversed by said layer and flame is suppressed within said sector while wastage of said material is alleviated.

2. The method as recited in claim 1 wherein said fire retardant material has the formula $C_nF_mX_p$ where n is 1 to 2, m is at least 1, X is selected from a group comprising elements Br and Cl and combinations of said elements, and m plus p equals 2n plus 2.

3. The method as recited in claim 1, wherein said enclosed area is in the body of an aircraft.

4. The method as recited in claim 1 said method being further characterized in that said material is dispersed at velocities which are sufficiently low to prevent said dispersion of material from forming air currents that would impede said suppression of fire by aid layer but sufficiently high to enable said layer to form and descend.

5. The method as recited in claim 4, wherein said fire retardant material is between about three to seven times as dense as air at standard temperature and pressure.

6. The method as recited in claim 4, wherein said material is dispersed in a concentration in air in said layer of about two percent to seven percent by volume.

7. The method as recited in claim 4, wherein said fire retardant material has the formula $C_nF_mX_p$ where n is 1 to 2, m is at least 1, X is selected from a group comprising elements Br and Cl and combinations of said elements, and m plus p equals 2n plus 2.

8. The method as recited in claim 4, wherein said fire retardant material comprises bromotrifluoromethane.

9. The method as recited in claim 4, wherein said enclosed area is in the body of an aircraft, said area being accessible to crew during flight.

10. A system for combatting fire in a fire suppression sector of an enclosed area that is defined by an enclosing structure, said area containing air and having an upper region, an intermediate region, and a lower region, said system comprising:

a. plenum means;

b. a means for supplying a fire retardant material to said plenum means;

c. a discharge means through which said material is able to be discharged from said plenum means, said system being arranged to form in said upper region a layer of at least a minimum concentration of said material which is sufficient to suppress flame, said layer extending substantially continuously across said sector, said material having a density and a particle size such that said layer is able to descend through said air by gravity;

d. said enclosing structure and said discharge means being arranged so that said air in said sector is sufficiently still to permit said layer of at least said minimum concentration while descending from said upper region through said intermediate and lower regions to extend substantially continuously across said sector, whereby said sector is traversed by said layer and flame is suppressed within said sector, while wastage of said material is alleviated.

11. The system as recited in claim 10, wherein said fire retardant material has the formula $C_nF_mX_p$ where n is 1 to 2, m is at least 1, X is selected from a group comprising elements Br and Cl and combinations of said elements, and m plus p equals 2n plus 2.

12. The system as recited in claim 10, wherein said enclosed area has a length dimension and said plenum means extends substantially said length dimension.

13. The system as recited in claim 10 wherein said system is in the body of an aircraft in which there is a deck dividing said body into an upper compartment having said plenum means and said discharge means, and a lower compartment having said plenum means and said discharge means.

14. A system for combatting fire in an enclosed area which has an upper region, an intermediate region, and a lower region, said system comprising:

a. plenum means;

b. means connected to said plenum means for supplying fire retardant material to said plenum means;

c. discharge means positioned in said upper region connected to said plenum means and through which said material can be dispersed from said plenum means to form a layer of said material in air in said upper region, said material have a weight, density, and particle size such that said material descends through air by gravity, said layer maintaining a concentration of said material sufficient to repress flame within said layer, said material being dispersed in a manner such that said layer descends from said upper region through said intermediate and lower regions to suppress flame within said area.

d. said discharge means comprising:

i. nozzle means having aperture means for releasing said material in a first path in said upper region, said first path being downward;

ii. means fixed to said nozzle means and positioned below said aperture means, for deflecting said first path into at least one horizontal path, said deflection means being generally perpendicular to said first path, said material being dispersed at velocities controlled by said discharge means which are sufficiently low to prevent said dispersion from forming air currents that would impede said suppression of fire by said layer but sufficiently high to enable said layer to form and descend.

15. The system as recited in claim 14, wherein air enters said enclosed area through means adjacent to said upper region and air and fire retardant material exit from said area through means adjacent to said lower region.

16. The system as recited in claim 14, wherein said fire retardant material has the formula $C_nF_mX_p$ where n is 1 to 2, m is at least 1, X is selected from a group comprising elements Br and Cl and combinations of said elements, and m plus p equals 2n plus 2.

17. The system as recited in claim 14, wherein said system is in the body of an aircraft in which there is a deck dividing said body into an upper compartment having said plenum means and said discharge.

18. A system for combatting fire in an enclosed area which has an upper region, and intermediate region, and a lower region, said system comprising:

a. plenum means;

b. means connected to said plenum means for supplying fire retardant material to said plenum means;

c. discharge means positioned in said upper region connected to said plenum means and through which said material can be dispersed from said plenum means to form a layer of said material in air in said upper region, said material have a weight, density, and particle size such that said material descends through air by gravity, said layer maintaining a concentration of said material sufficient to repress flame within said layer, said material being dispersed in a manner such that said layer descends from said upper region through said intermediate and lower regions to suppress flame within said area.

d. said discharge means comprising:

i. means connected to said conduit means which contain first passageway means communicating with said conduit means, said first passageway means having an opening in said upper region which extends parallel to said conduit means, said conduit means having longitudinal and vertical axes and a locating plane containing said axes, said first passageway means deflecting the path of travel of said first retardant material and dispensing said material into said upper region in a first generally horizontal direction away from said locating plane;

ii. means connected to said conduit means which contain second passageway discharge means communicating with said conduit means, said second passageway means having an opening in said upper region which extends parallel to said conduit means, said second passageway means deflecting the path of travel of said material and dispersing said material into said upper region in a second generally horizontal direction away from said locating plane, said material being dispersed at velocities controlled by said discharge means which are sufficiently low to prevent said dispersion from forming air currents that would impede said suppression of fire by said layer but sufficiently high to enable said layer to form and descend.

19. The system as recited in claim 18, wherein said fire retardant material has the formula $C_nF_mX_p$ where n is 1 to 2, m is at least 1, X is selected from a group comprising elements Br and Cl and combinations of said elements, and m plus p equals 2n plus 2.

20. The system as recited in claim 18 wherein said system is in the body of an aircraft in which there is a deck dividing said body into an upper compartment having said plenum means and said discharge means, and a lower compartment having said plenum means and said discharge means.

* * * * *